US006027236A

United States Patent [19]

McDonnell

[11] Patent Number: 6,027,236

[45] Date of Patent: Feb. 22, 2000

[54] LIGHT ASSEMBLY FOR A VEHICLE HAVING A COLLAR AND SOCKET LOCKING CONNECTION

[75] Inventor: Jason A. M. McDonnell, Columbus, Ohio

[73] Assignee: Honda Giken Kogyo Kabushiki Kaisha, Tokyo, Japan

[21] Appl. No.: 08/985,216

[22] Filed: Dec. 4, 1997

[51] Int. Cl.[7] ..... F21Q 1/00

[52] U.S. Cl. ..... 362/510; 362/226

[58] Field of Search ..... 362/226, 310, 362/516, 519

[56] References Cited

U.S. PATENT DOCUMENTS

| | | | |
|---|---|---|---|
| 3,803,397 | 4/1974 | Dick | 240/8.2 |
| 4,054,792 | 10/1977 | Brudy | 362/267 |
| 4,459,644 | 7/1984 | Bailly | 362/80 |
| 4,513,356 | 4/1985 | Mikola | 362/226 |
| 4,564,891 | 1/1986 | Daumüller et al. | 362/294 |
| 4,612,607 | 9/1986 | Segoshi et al. | 362/267 |
| 4,703,401 | 10/1987 | Ichihara et al. | 362/80 |
| 4,731,709 | 3/1988 | Freudenreich et al. | 362/80 |
| 4,760,506 | 7/1988 | Mochizuki et al. | 362/226 X |
| 4,841,419 | 6/1989 | Ohishi | 362/226 |
| 5,010,455 | 4/1991 | Luallin et al. | 362/519 |
| 5,180,224 | 1/1993 | Svehaug | 362/255 |
| 5,816,686 | 10/1998 | Wang et al. | 362/226 |
| 5,855,430 | 1/1999 | Coushaine et al. | 362/519 |

*Primary Examiner*—Laura K. Tso

*Attorney, Agent, or Firm*—Armstrong, Westerman, Hattori, McLeland & Naughton

[57] ABSTRACT

A light assembly for a motor vehicle has a reflector with an opening at the rear and a collar extending from about the opening, and a socket which fits through the opening and has a first end for holding a bulb and a second end with a locking device thereon which engages with another locking device in the outer surface of the collar, with a supplemental reflector also preferably provided at the first end of the socket.

19 Claims, 7 Drawing Sheets

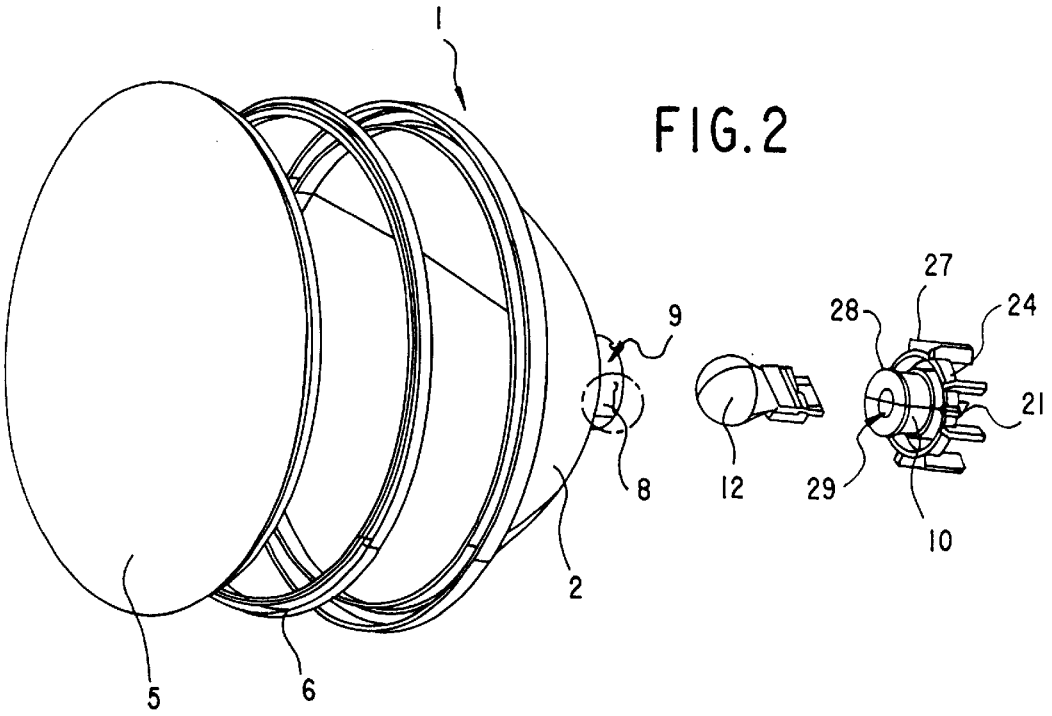
FIG.2
FIG.2A
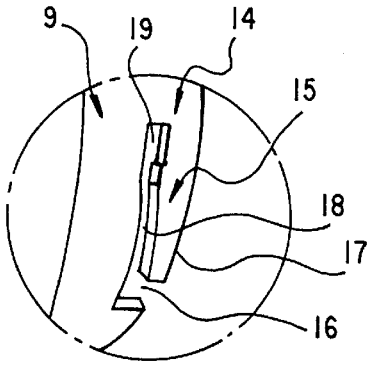

LIGHT ASSEMBLY FOR A VEHICLE HAVING A COLLAR AND SOCKET LOCKING CONNECTION

BACKGROUND OF THE INVENION

1. Field of the Invention

The present invention relates to a light assembly for a vehicle, and more particularly to a taillight assembly for a motor vehicle.

2. Background of the Invention

Motor vehicles have a series of lights, including headlights, turn-indicating signal lights, parking lights and taillights. Such vehicle lights conventionally include a reflector, such as on elliptical or parabolic-shaped device, in which a bulb is disposed, with light from the bulb reflected outwardly through a protective lens. The bulb is held in place by an electrical connector which is used to light the bulb when desired. The light assembly, including the reflector and protective lens is secured to a body portion of the motor vehicle. Conductive electrical leads to energize the bulb are usually associated with a socket which retains the bulb, with the socket being connected to the base of the reflector. A cap is usually used to secure the socket to the base of the reflector, generally by use of a fitting which extends into the base of the reflector and which is secured to the base. In such light assemblies, the inserted fitting does not reflect the light of the bulb at the base and a ring of darkness is created around the bulb when it is lit, which decreases the illumination effected by the bulb.

It is an object of the present invention to provide a vehicle light assembly, particularly a taillight assembly, that provides for additional illumination through use of a supplemental reflector.

SUMMARY OF THE INVENTION

A light assembly for a vehicle has a reflector, with an opening at the rear portion of the reflector, and a collar extending rearwardly from the reflector and surrounding the opening. The collar has a first locking device on the outer surface thereof. A socket is provided which extends through the opening of the reflector and holds a bulb at an end confined within the reflector, while a rearwardly extending end of the socket extends from the collar and has a second locking device which engages with the first locking device on the collar's outer surface to secure the socket and the reflector together.

Preferably, the first locking device includes at least one locking groove in the outer surface of the collar on the reflector while the second locking device includes at least one locking arm that is disposed on a flange of a plate at the rear portion of the socket. A plurality of gripping members may also be provided on the rear portion of the socket for easy gripping and securement of the socket with the reflector.

In one embodiment of the light assembly a supplemental reflector is provided at the end of the socket engaging the bulb, which supplemental reflector is preferably parabolic in shape and extends substantially across the opening at the rear portion of the reflector.

BRIEF DESCRIPTION OF THE DRAWINGS

The invention will be more readily understood by reference to the attached drawings illustrating embodiments thereof, wherein:

FIG. 2 is an exploded view of the light assembly illustrated in FIG. 1 with FIG. 2-A showing an enlargement of the area within the circle of FIG. 2;

DETAILED DESCRIPTION OF THE INVENTION

The present invention provides a light assembly, particularly a taillight assembly, for a motor vehicle which is easily and economically manufactured and readily and quickly assembled into a section of a vehicle. In a preferred embodiment, the light assembly provides additional illumination as compared with conventional vehicle light assemblies.

Figure 1:
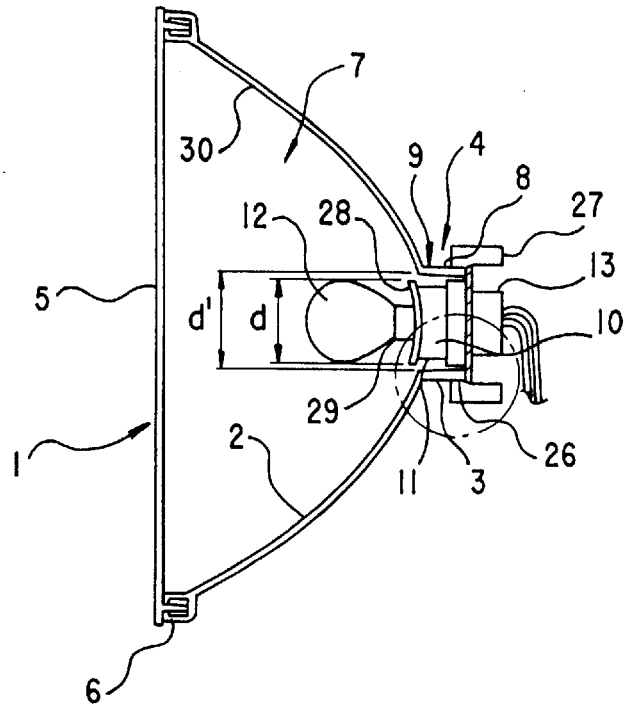
FIG. 1 is a sectional view of a light assembly for a vehicle according to the present invention, with FIG. 1A showing an enlargement of the area within the circle of FIG. 1.
Figure 1A:
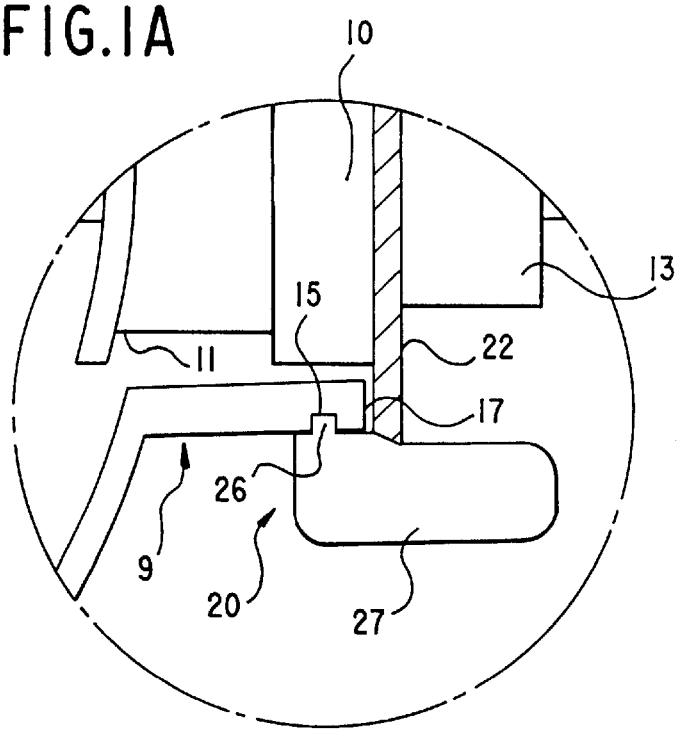
Figure 3:
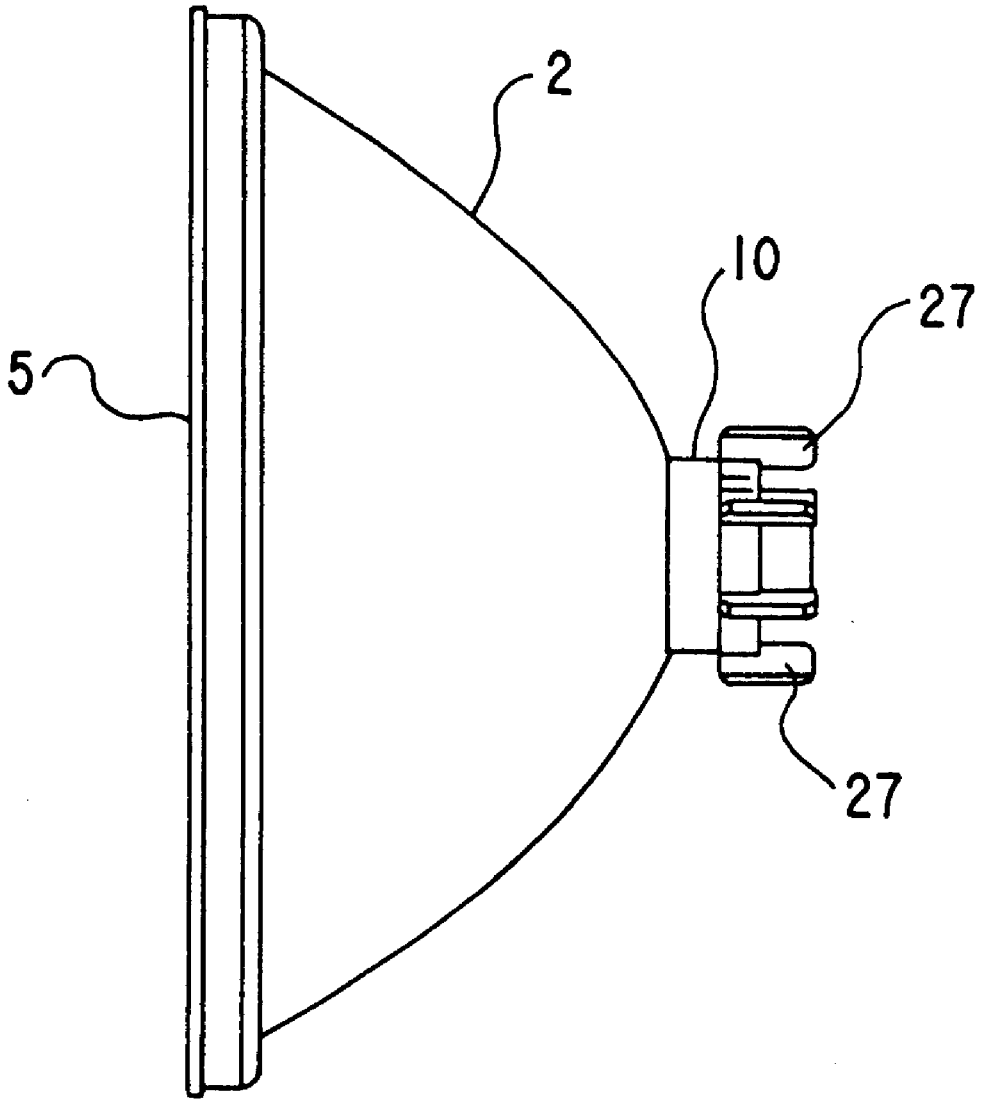
FIG. 3 is a side view of the light assembly illustrated in FIG. 1.

Referring now to the drawings, FIG. 1 illustrates a taillight 1 assembly of the present invention. The light assembly 1, is secured in a section (not shown) of a motor vehicle and has a reflector 2, preferably dish-shaped, which has an opening 3 at the rear portion 4 thereof, and a glass or plastic lens 5 and gasket 6 which close off the front of the reflector and seal the interior 7 of the reflector from the environment.

A collar 8 is provided on the light assembly 1 which surrounds the opening 4 and extends rearwardly therefrom, the collar 8 having an outer surface 9. The term rearward as used in the present description is used to identify a direction away from the lens 5 of the light assembly towards the collar 8, while the term forward indicates the opposite direction. A socket 10 is fitted in the collar 8, which socket 10 extends through the opening 3 of the reflector 2 and has a first end 11 that is positioned within the confines of the reflector 2 and holds a bulb 12, and a second end 13 which extends rearwardly from the collar 8.

Figure 5:
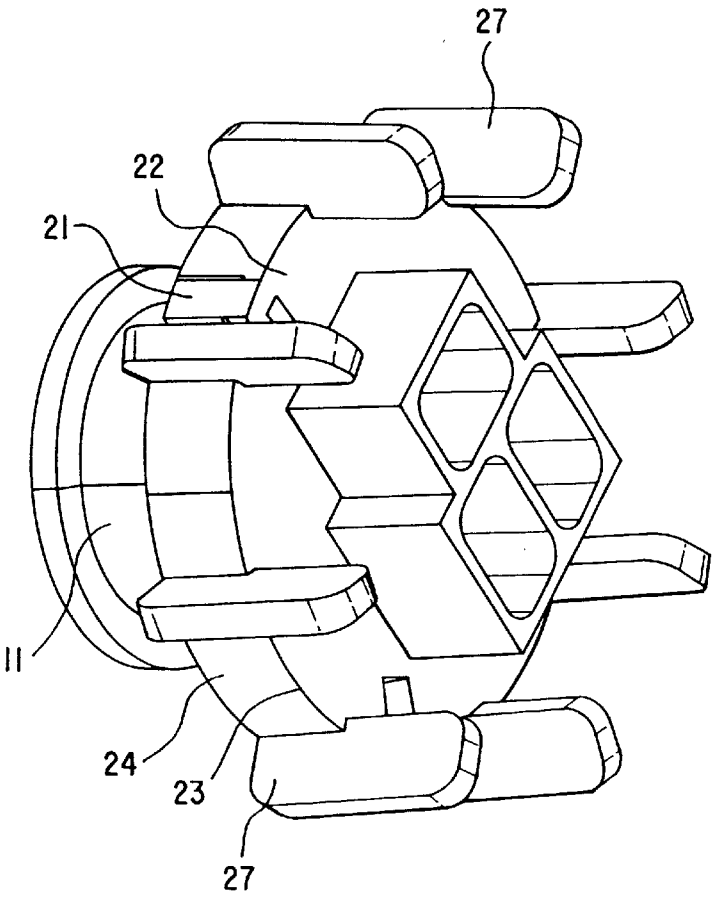
FIG. 5 is an isometric rear view of the socket shown in FIG. 1 with the bulb removed.
Figure 4:
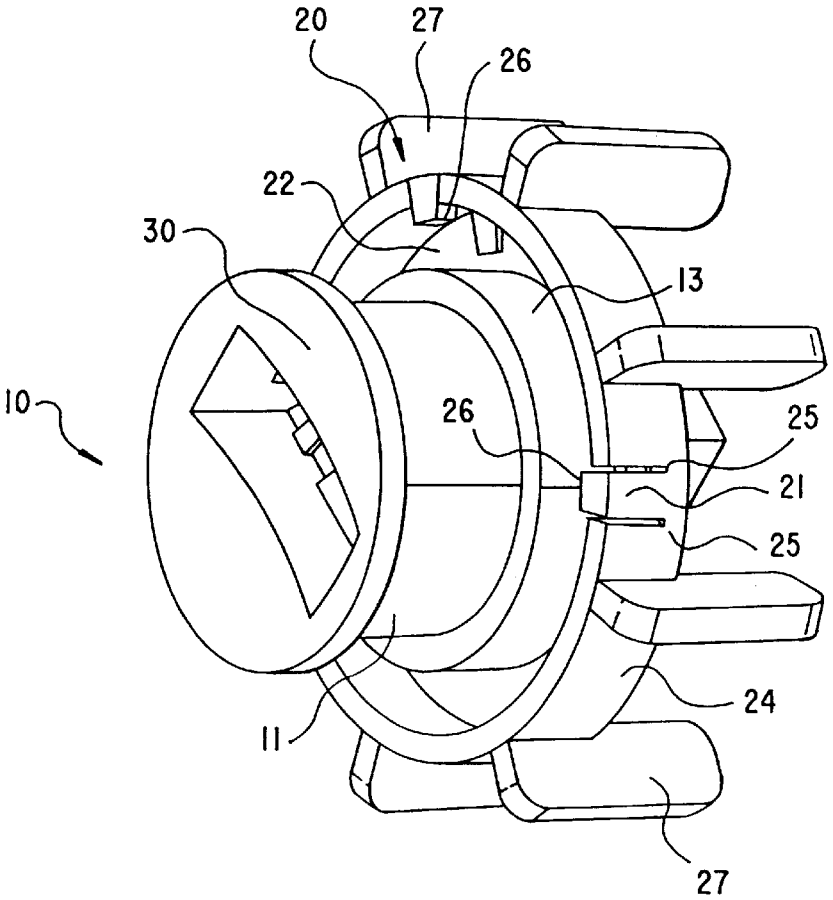
FIG. 4 is an isometric frontal view of the socket of the light assembly of FIG. 1 with the bulb removed.

As shown in FIGS. 1, 1A, 2 and 2A, a first locking means 14, such as a plurality of grooves 15 are provided in the outer surface 9 of the collar 8 on the reflector 2 with each of the grooves 15 preferably formed as axially directed groove sections 16 (FIG. 2A) extending forwardly from the end wall 17 of the collar 8 and cooperating circumferentially extending groove sections 18 which terminate as groove recesses 19. As shown in FIGS. 4 and 5, a second locking means 20 is provided which extends from the second end 13 of socket 10 and which is in the form of a plurality of locking arms 21 which extend forwardly to engage with the plurality of grooves 15 (FIGS. 2 and 2A) in the outer surface 9 of the collar 8.

Referring again to FIGS. 4 and 5, which better illustrate the socket 10, socket 10 preferably has a circular plate 22 at the second end 13 which has a diameter which is greater than the diameter of the collar 8 and an outer peripheral wall 23.

Figure 6:
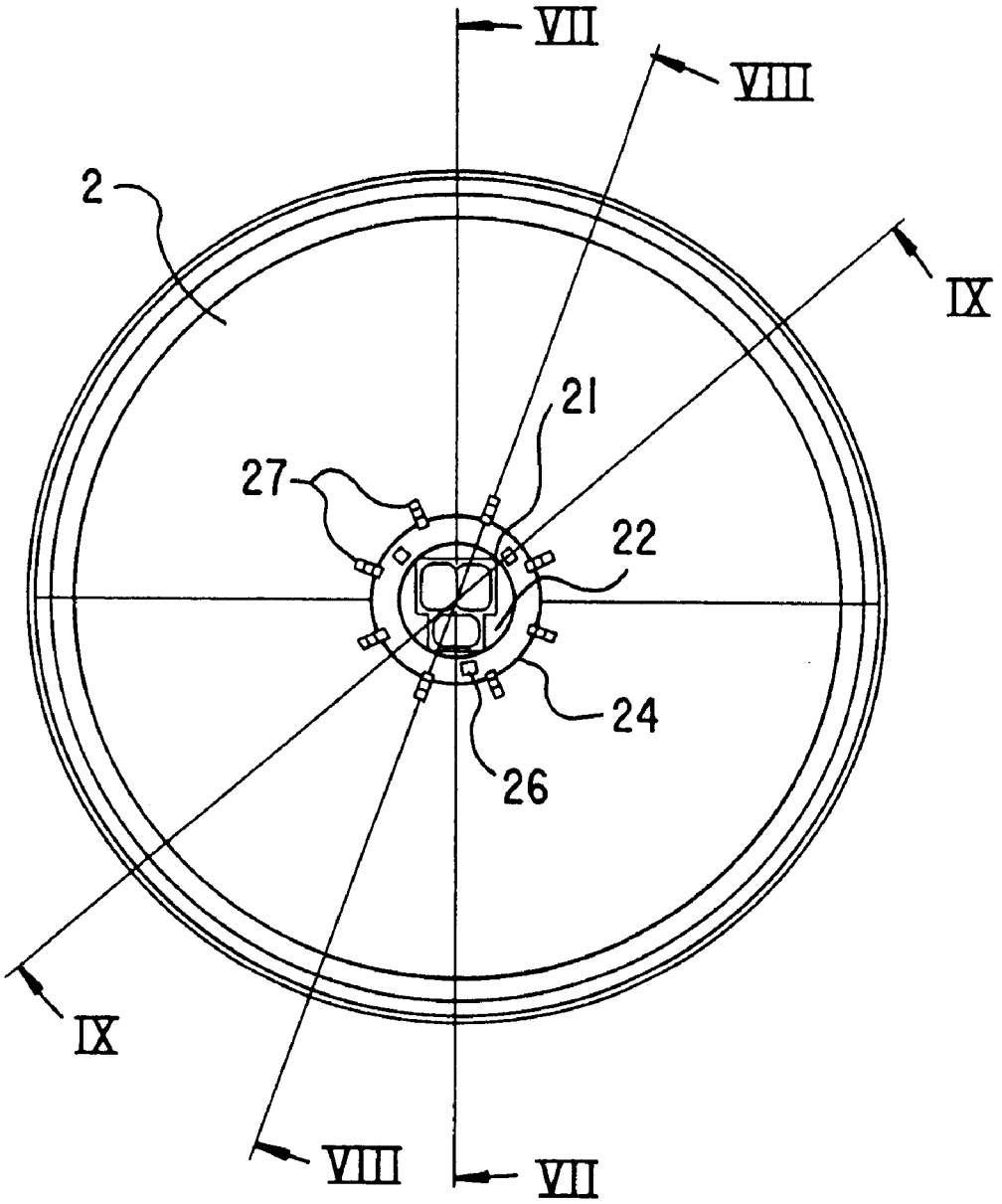
FIG. 6 is a rear view of the light assembly of the present invention.
Figure 9:
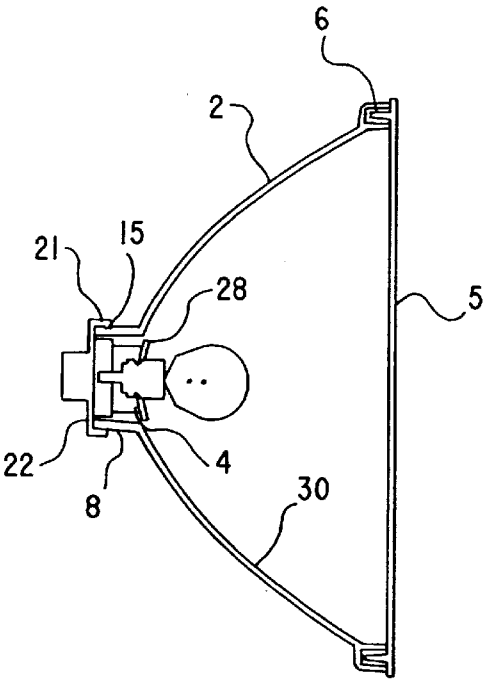
FIG. 9 is a cross-sectional view taken along lines IX—IX of FIG. 6.
Figure 8:
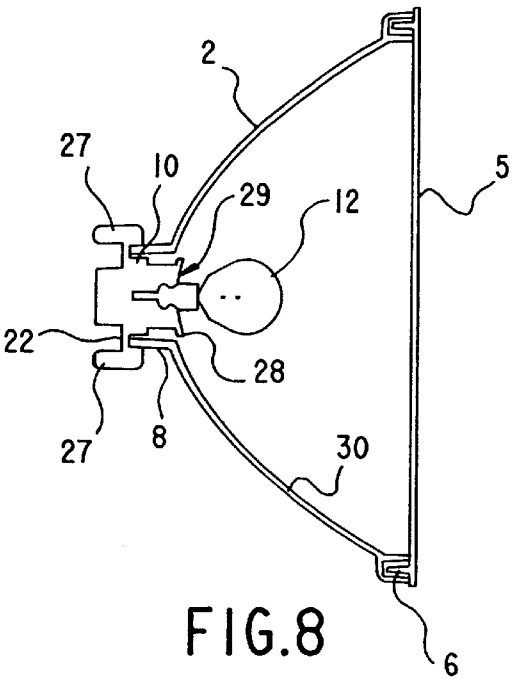
FIG. 8 is a cross-sectional view taken along lines VIII—VIII of FIG. 6.
Figure 7:
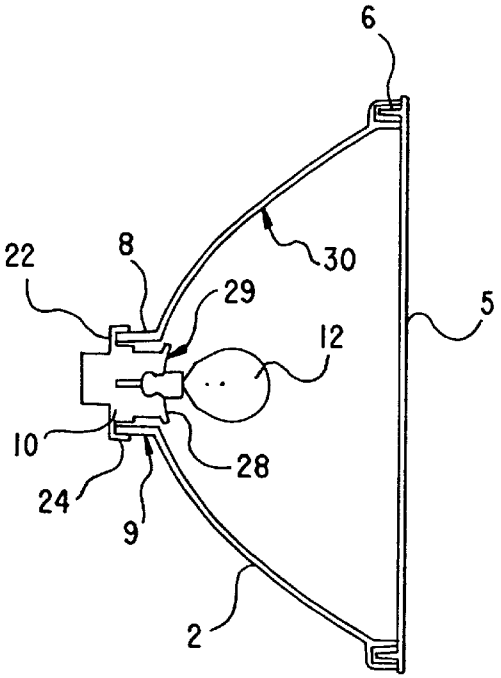
FIG. 7 is a cross-sectional view taken along lines VII—VII of FIG. 6.

A forwardly extending flange 24 is formed on the outer peripheral wall 23 which extends in the direction of the first end 11 of the socket 10. The plurality of locking arms 21 are preferably formed by providing slits 25 in the forwardly extending flange 24, with each locking arm 21 having an inwardly depending projection 26 at the end thereof. In a preferred embodiment of the light assembly 1, at least three equally circumferentially spaced grooves 15 are provided in the outer surface of the outer surface 9 of the collar 8, and at least three cooperating locking arms 21 (FIG. 6) are provided on the socket 10 so as to provide an optimal locking force or axial support to prevent movement of the socket under vibratory conditions, while providing ease of mounting of the socket 10 to the collar 8 of the reflector 2. To assist in mounting or removal of the socket 10 from the collar 8 of the reflector 2, a plurality of gripping members 27 are provided which extend rearwardly from the flange 24 on the plate 22.

In a preferred embodiment of the light assembly 1 of the present invention, a supplemental reflector is provided so as to provide additional illumination from the light assembly as compared to conventional such light assemblies. As best illustrated in FIGS. 1 and 7 to 9, a supplemental reflector 28 is provided at the first end 11 of the socket 10, which supplemental reflector is preferably parabolic in shape and has a surface 29 which is complementary with the curvature of the inner surface 30 of the reflector 2. The diameter d of the supplemental reflector 28 is sized such that it is only slightly less than the diameter d' of the opening 3 in the reflector 2 so as to permit insertion of the supplemental reflector 28 through the opening 4 while providing a maximal reflecting surface area of the surface 29 of the supplemental reflector 28.

In operation, the first end 11 of the socket 10, carrying the supplemental reflector 28 when used, is inserted through collar 8 and opening 3 in the reflector 2. The user then grasps the socket 10, preferably by the gripping members 27 on flange 24 and aligns the locking arms 21 with the axial groove sections 16 of grooves 15 in the outer surface 9 of collar 8. Forward axial movement of the locking arms is effected until the projections 26 on the locking arms 21 are aligned with circumferential groove sections 18 of the grooves 15. The socket 10 is then rotated such that the projections move through the circumferential groove sections 18 and are finally seated in recesses 19 of the grooves 15 to lock the socket 10 to the collar 8. For removal of the socket 10 from the collar 8 to replace a bulb 12, or for any other reason, the aforementioned steps are reversed.

Figure 10:
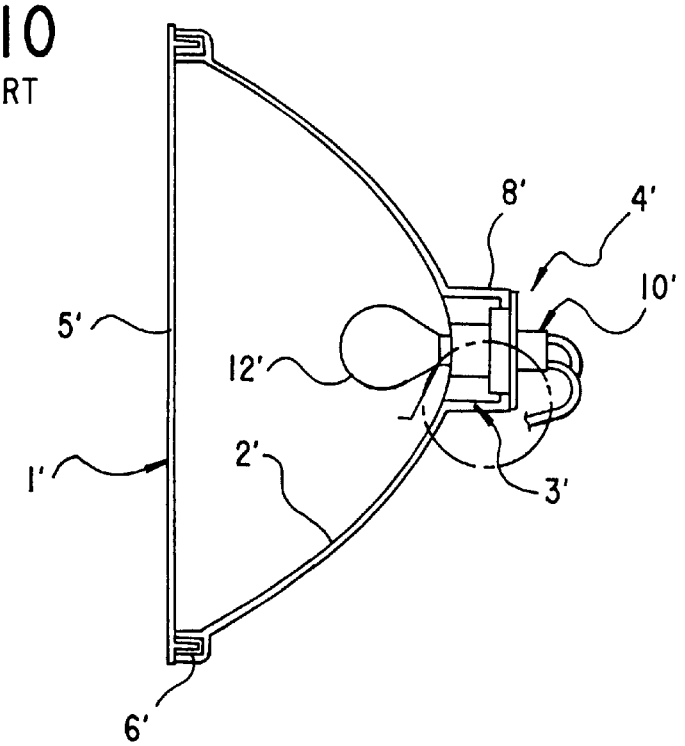
FIG.10 PRIOR ART
FIG. 10 is a sectional view of a prior art light assembly for a motor vehicle, with FIG. 10A showing an enlargement of the area within the circle of FIG. 10.
Figure 10A:
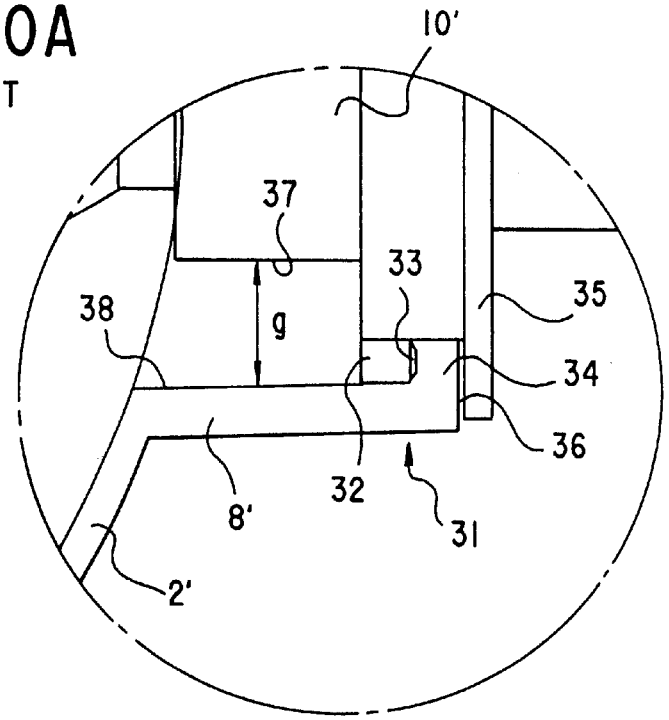
FIG.10A PRIOR ART

The advantages of the taillight of the present invention as illustrated in FIGS. 1–9, are apparent when the taillight is compared with a prior art taillight as illustrated in FIG. 10. As shown, the prior art taillight 1' of FIG. 10 has a reflector 2' which contains a bulb 12' that is activated through a connector 10', with light from the bulb reflected outwardly through a protective lens 5' attached by a gasket 6'. The reflector 2' has an opening 3' at the rear portion 4'. A collar 8' surrounds the opening 3'. A socket 10', having electrical leads, contains the bulb 12', and the socket 10' is being releasably secured to the exposed end 31 of the collar 8'. The releasable securement is effected by lugs 32 on the socket 10' which are inserted into and engage with the inner surface 33 of an inwardly directed flange 34 at the exposed end 31 of the collar 8', which secure the flange 34 between lugs 32 and a spaced cap member 35 which is sized to contact an outer surface 36 of the flange 34. As shown in FIG. 10, with the lugs 32 provided as an engagement means on the socket 10', the lugs must enter the collar 8' so as to engage with inwardly directed flange 34. This results in a gap g, or ring of darkness, between a sidewall 37 of socket 10' and the inner wall 38 of the socket 8'. The gap g results in a ring of darkness which does not reflect any light from the bulb 12'.

By contrast, with the present invention, with no engagement means required within the socket 8, the supplemental reflector 28 may be inserted through the opening 3 with the ring of darkness eliminated and only a small distance provided between d and d'.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. A light assembly for a vehicle, comprising:

a reflector having an opening at a rear portion thereof;

a collar extending rearwardly from said reflector, surrounding said opening, and having an outer surface;

a first locking means on the outer surface of said collar;

a socket extending through the opening of said reflector, said socket having a first end holding a bulb within the confines of the reflector, and a second end extending rearwardly from said collar, said first end being attached to said second end, and not movable with respect to one another; and a second locking means extending from the second end of said socket engaging in the outer surface of said collar to secure the socket to the reflector.

2. A light assembly for a vehicle as defined in claim 1 wherein the second end of said socket includes a plate with an outer periphery and a forwardly extending flange is provided about said periphery, said flange carrying said second locking means.

3. A light assembly for a vehicle as defined in claim 2 wherein the first locking means includes at least one locking groove in the outer surface of said collar and the second locking means includes at least one locking arm on the flange of said plate for engagement with said at least one groove.

4. A light assembly for a vehicle as defined in claim 3 wherein at least three of said locking grooves are provided spaced about the outer surface of said collar and at least three of said locking arms are provided for engagement with said at least three grooves.

5. A light assembly for a vehicle as defined in claim 3 wherein said at least one locking groove has an axially forwardly extending groove section extending from an end wall of said collar, a circumferentially extending groove section cooperating with said axially forwardly extending groove section, and a groove recess at the terminus of said circumferentially extending groove section.

6. A light assembly for a vehicle as defined in claim 2 wherein a plurality of gripping members are provided on said flange extending rearwardly from said socket.

7. A light assembly for a vehicle, comprising:

a reflector having an opening at a rear portion thereof;

a collar extending rearwardly from said reflector, surrounding said opening, and having an outer surface;

a first locking means on the outer surface of said collar;

a socket extending through the opening of said reflector, said socket having a first end holding a bulb within the confines of the reflector, and a second end extending rearwardly from said collar;

a second locking means extending from the second end of said socket engaging in the outer surface of said collar to secure the socket to the reflector; and a supplemental reflector provided at the first end of said socket which extends substantially across the opening at the rear portion of said reflector.

8. A light assembly for a vehicle as defined in claim 7 wherein said supplemental reflector is parabolic in shape.

9. A light assembly for a vehicle, comprising:

a reflector having an opening at a rear portion thereof;

a collar extending rearwardly from said reflector, surrounding said opening, and having an outer surface;

a first locking means on the outer surface of said collar;

a socket extending through the opening of said reflector, said socket having a first end holding a bulb within the confines of the reflector, and a second end extending rearwardly from said collar and including a plate thereon;

a second locking means extending from the plate of the second end of said socket engaging in the outer surface of said collar to secure the socket to the reflector; and a supplemental reflector provided at the first end of said socket which extends substantially across the opening at the rear portion of said reflector.

10. A light assembly for a vehicle, comprising:

a reflector having an opening at a rear portion thereof;

a collar extending rearwardly from said reflector, surrounding said opening, and having an outer surface;

a first locking means, including at least one locking groove in the outer surface of said collar;

a socket extending through the opening of said reflector, said socket having a first end holding a bulb within the confines of the reflector, and a second end extending rearwardly from said collar and having a plate thereon with an outer periphery and a forwardly extending flange provided about said periphery, said first end being attached to said second end, and not movable with respect to one another; and a second locking means extending from the plate of the second end of said socket engaging in the outer surface of said collar, comprising at least one locking arm on the flange of said plate for engagement with said at least one groove, to secure the socket to the reflector.

11. A light assembly for a vehicle as defined in claim 10 wherein at least three of said locking grooves are provided spaced equally about the outer surface of said collar and at least three of said locking arms are provided for engagement with said at least three grooves.

12. A light assembly for a vehicle as defined in claim 10 wherein a plurality of gripping members are provided on said flange extending rearwardly from said socket.

13. A light assembly for a vehicle, comprising:

a reflector having an opening at a rear portion thereof;

a collar extending rearwardly from said reflector, surrounding said opening, and having an outer surface;

a first locking means, including at least one locking groove in the outer surface of said collar;

a socket extending through the opening of said reflector, said socket having a first end holding a bulb within the confines of the reflector, and a second end extending rearwardly from said collar and having a plate thereon with an outer periphery and a forwardly extending flange provided about said periphery;

a second locking means extending from the plate of the second end of said socket engaging in the outer surface of said collar, comprising at least one locking arm on the flange of said plate for engagement with said at least one groove, to secure the socket to the reflector; and a supplemental reflector provided at the first end of said socket which extends substantially across the opening at the rear portion of said reflector.

14. A light assembly for a vehicle as defined in claim 13 wherein said supplemental reflector is parabolic in shape.

15. A light assembly for a vehicle, comprising:

a reflector having an opening at a rear portion thereof;

a collar extending rearwardly from said reflector, surrounding said opening, and having an outer surface with plurality of locking grooves formed in said outer surface;

a socket extending through the opening of said reflector, said socket having a first end holding a bulb within the confines of the reflector, and a second end extending rearwardly from said collar and having a plate thereon, said plate having an outer periphery with a forwardly extending flange about said periphery, the flange having at least one locking arm thereon for engagement with said locking grooves to secure the socket to the reflector; and a supplemental reflector at the first end of said socket which extends substantially across the opening at the rear portion of said reflector.

16. A light assembly for a vehicle as defined in claim 15 wherein at least three of said locking grooves are provided spaced about the outer surface of said collar and at least three of said locking arms are provided for engagement with said at least three grooves.

17. A light assembly for a vehicle as defined in claim 16 wherein a plurality of gripping members are provided on said flange extending rearwardly from said socket.

18. A light assembly for a vehicle as defined in claim 15 wherein said supplemental reflector is parabolic in shape.

19. A light assembly for a vehicle as defined in claim 15 wherein each of said plurality of locking grooves has an axially forwardly extending groove section extending from an end wall of said collar, a circumferentially extending groove section cooperating with said axially forwardly extending groove section, and a groove recess at the terminus of said circumferentially extending groove section.

* * * * *